US012295489B1

(12) United States Patent
Tang

(10) Patent No.: US 12,295,489 B1
(45) Date of Patent: May 13, 2025

(54) POWERED LIFTING TABLE

(71) Applicant: MARINA TF PTE. LTD., Singapore (SG)

(72) Inventor: Yongfei Tang, Shanghai (CN)

(73) Assignee: MARINA TF PTE. LTD., Singapore (SG)

( * ) Notice: Subject to any disclaimer, the term of this patent is extended or adjusted under 35 U.S.C. 154(b) by 0 days.

(21) Appl. No.: 18/771,602

(22) Filed: Jul. 12, 2024

(51) Int. Cl.
*A47B 9/16* (2006.01)

(52) U.S. Cl.
CPC ..... *A47B 9/16* (2013.01); *A47B 2200/0058* (2013.01)

(58) Field of Classification Search
CPC ..... A47B 9/16; A47B 2200/0058; A47B 2200/005; A47B 2200/0063; A47B 2200/005; A47B 2003/025; A47B 21/02
USPC ..... 108/144.11, 15, 117, 20, 145, 147, 128, 108/116; 248/421, 562, 588, 585, 431, 248/432, 439, 436
See application file for complete search history.

(56) References Cited

U.S. PATENT DOCUMENTS 2,799,546 A * 7/1957 Lowry ..... A47B 3/0918 108/44
4,718,355 A * 1/1988 Houghton ..... A47B 9/16 108/147
8,752,675 B2 * 6/2014 Berends ..... B66F 7/065 187/210
2010/0325797 A1 * 12/2010 Horne ..... B66F 7/0691 248/421
2015/0272316 A1 * 10/2015 Flaherty ..... A47B 3/0818 108/116
2020/0022491 A1 * 1/2020 Ren ..... A47B 21/0073
2021/0345768 A1 * 11/2021 Dowdle ..... A47B 21/04

FOREIGN PATENT DOCUMENTS

| | | | | |
|---|---|---|---|---|
| CN | 109019418 | A | * | 12/2018 |
| CN | 215649739 | U | | 1/2022 |
| CN | 217771744 | U | | 11/2022 |
| CN | 217771755 | U | | 11/2022 |
| CN | 219661177 | U | | 9/2023 |
| DE | 202006013998 | U1 | * | 12/2006 |
| GB | 2341790 | A | * | 3/2000 |
| KR | 20170109792 | A | * | 10/2017 |
| KR | 20210125187 | A | * | 10/2021 |

(Continued)

OTHER PUBLICATIONS

Tang, Yongfei et al., "Powered Lifting Table," U.S. Appl. No. 18/407,089, filed Jan. 8, 2024.

(Continued)

*Primary Examiner* — Janet M Wilkens
(74) *Attorney, Agent, or Firm* — Polygon IP, LLP

(57) ABSTRACT

A lifting table with a large height adjustment range is provided. The lifting table includes two opposing leg assemblies that each include a first leg portion and a second leg portion. The first leg portion and the second leg portion are hingedly coupled. An end of each of the first leg portion is mounted to a track and configured to move along the track to adjust the height of the table. As the first leg portion moves along the track, the angle of the first leg portion relative to the second leg portion changes.

20 Claims, 7 Drawing Sheets

(56) References Cited

FOREIGN PATENT DOCUMENTS

KR 102340316 B1 * 12/2021
WO WO-2018045414 A1 * 3/2018

OTHER PUBLICATIONS

Tang, Yongfei et al., "Powered Lifting Table," U.S. Appl. No. 29/959,508, filed Aug. 26, 2024.
Tang, Yongfei et al., "Powered Lifting Table," U.S. Appl. No. 29/964,941, filed Sep. 25 ,2024.

* cited by examiner

POWERED LIFTING TABLE

FIELD OF TECHNOLOGY

This patent application relates generally to tables, and more specifically to powered lifting tables.

BACKGROUND

A desk is an essential part of daily life. Desks are used for work, leisure, and life activities. A single desk may have multiple different uses. Basic advancements for desks have followed, such as lifting tables, but typical lifting desks only utilize telescoping legs that may not provide enough stability.

SUMMARY

Described herein are systems and techniques for lifting tables. The lifting table may include a tabletop, tracks, disposed along a bottom of the tabletop a first leg assembly, and a second leg assembly. The first leg assembly may include a first assembly first leg portion, comprising a first assembly first leg portion first end and a first assembly first leg portion second end, where the first assembly first leg portion first end is translationally coupled to the tracks, a first assembly second leg portion, comprising a first assembly second leg portion first end and a first assembly second leg portion second end, where the first assembly second leg portion first end comprises a first hinge coupled to the tabletop, and where the first assembly first leg portion is disposed at an angle to the first assembly second leg portion and coupled to the first assembly second leg portion via a first leg hinge, and the first leg hinge, where the first leg hinge is coupled to the first assembly second leg portion second end and coupled to a central portion of the first assembly first leg portion. The second leg assembly may include a second assembly first leg portion, comprising a second assembly first leg portion first end and a second assembly first leg portion second end, where the second assembly first leg portion first end is translationally coupled to the tracks, a second assembly second leg portion, comprising a second assembly second leg portion first end and a second assembly second leg portion second end, where the second assembly second leg portion first end comprises a second hinge coupled to the tabletop, and where the second assembly first leg portion is disposed at an angle to the second assembly second leg portion and coupled to the second assembly second leg portion via a second leg hinge, and the second leg hinge, where the second leg hinge is coupled to the second assembly second leg portion second end and coupled to a central portion of the second assembly first leg portion.

Clause 1. A lifting table comprising: a tabletop; tracks, disposed along a bottom of the tabletop; a first leg assembly, comprising: a first assembly first leg portion, comprising a first assembly first leg portion first end and a first assembly first leg portion second end, wherein the first assembly first leg portion first end is translationally coupled to the tracks; a first assembly second leg portion, comprising a first assembly second leg portion first end and a first assembly second leg portion second end, wherein the first assembly second leg portion first end comprises a first hinge coupled to the tabletop, and wherein the first assembly first leg portion is disposed at an angle to the first assembly second leg portion and coupled to the first assembly second leg portion via a first leg hinge; and the first leg hinge, wherein the first leg hinge is coupled to the first assembly second leg portion second end and coupled to a central portion of the first assembly first leg portion; and a second leg assembly, comprising; a second assembly first leg portion, comprising a second assembly first leg portion first end and a second assembly first leg portion second end, wherein the second assembly first leg portion first end is translationally coupled to the tracks; a second assembly second leg portion, comprising a second assembly second leg portion first end and a second assembly second leg portion second end, wherein the second assembly second leg portion first end comprises a second hinge coupled to the tabletop, and wherein the second assembly first leg portion is disposed at an angle to the second assembly second leg portion and coupled to the second assembly second leg portion via a second leg hinge; and the second leg hinge, wherein the second leg hinge is coupled to the second assembly second leg portion second end and coupled to a central portion of the second assembly first leg portion.

Clause 2. The lifting table of clause 1, wherein the tracks comprise a first track assembly and a second track assembly.

Clause 3. The lifting table of clause 2, wherein: the first track assembly comprises: a first assembly first sliding track; and a first adjustment screw; and the second track assembly comprises: a second assembly first sliding track; and a second adjustment screw.

Clause 4. The lifting table of clause 3, wherein the first assembly first leg portion further comprises a first threaded portion receiver configured to receive the first adjustment screw, and wherein the second assembly first leg portion further comprises a second threaded portion receiver configured to receive the second adjustment screw.

Clause 5. The lifting table of clause 4, wherein the first assembly first leg portion first end is translationally coupled to the first assembly first sliding track, and wherein the second assembly first leg portion first end is translationally coupled to the second assembly first sliding track.

Clause 6. The lifting table of clause 5, wherein the first assembly first leg portion first end is translationally coupled to the first assembly first sliding track via a first sliding surface, and wherein the second assembly first leg portion first end is translationally coupled to the second assembly first sliding track via a second sliding surface.

Clause 7. The lifting table of clause 5, wherein: the first track assembly further comprises a first assembly second sliding track; the first assembly first leg portion first end is translationally coupled to the first assembly second sliding track; the second track assembly further comprises a second assembly second sliding track; and the second assembly first leg portion first end is translationally coupled to the second assembly second sliding track.

Clause 8. The lifting table of clause 6, wherein the first assembly first leg portion, at the first assembly first leg portion first end, comprises a first end first portion and a first end second portion.

Clause 9. The lifting table of clause 8, wherein the first end first portion and the first end second portion form a Y shape.

Clause 10. The lifting table of clause 9, wherein the first threaded portion receiver is disposed between the first end first portion and the first end second portion.

Clause 11. The lifting table of clause 8, wherein the first end first portion comprises a first slider hinge, and wherein the first end second portion comprises a second slider hinge.

Clause 12. The lifting table of clause 3, further comprising: a first motor configured to turn the first adjustment screw and/or the second adjustment screw.

Clause 13. The lifting table of clause 12, further comprising: a control panel configured to receive inputs and provide outputs to control operation of the first motor.

Clause 14. The lifting table of clause 12, wherein the first motor is configured to turn the first adjustment screw, and wherein the lifting table further comprises: a second motor configured to turn the second adjustment screw.

Clause 15. The lifting table of clause 3, wherein the first track assembly and the second track assembly are both disposed lengthwise along the bottom of the tabletop.

Clause 16. The lifting table of clause 15, wherein a first length of the first assembly first sliding track is more than half a length of the tabletop.

Clause 17. The lifting table of clause 16, wherein a second length of the second assembly first sliding track is more than half the length of the tabletop.

Clause 18. The lifting table of clause 17, wherein the first assembly first leg portion first end is configured to move in a first direction to lower a height of the tabletop, and wherein the second assembly first leg portion first end is configured to move in a second direction opposite the first direction to lower the height of the tabletop.

Clause 19. The lifting table of clause 18, wherein the first assembly first leg portion and the second assembly first leg portion crosses at a first height of the tabletop.

Clause 20. The lifting table of clause 18, wherein the first assembly first leg portion first end is configured to move in the second direction to raise a height of the tabletop, and wherein the second assembly first leg portion first end is configured to move in the first direction opposite the second direction to raise the height of the tabletop.

These and other embodiments are described further below with reference to the figures.

BRIEF DESCRIPTION OF THE DRAWINGS

The included drawings are for illustrative purposes and serve only to provide examples of possible structures and operations for the disclosed inventive systems, apparatus, and methods for lifting tables. These drawings in no way limit any changes in form and detail that may be made by one skilled in the art without departing from the spirit and scope of the disclosed implementations.

DETAILED DESCRIPTION

In the following description, numerous specific details are outlined to provide a thorough understanding of the presented concepts. The presented concepts may be practiced without some or all of these specific details. In other instances, well-known process operations have not been described in detail to not unnecessarily obscure the described concepts. While some concepts will be described in conjunction with the specific embodiments, it will be understood that these embodiments are not intended to be limiting.

In the following description, various techniques and mechanisms may have been described in singular form for clarity. However, it should be noted that some embodiments include multiple iterations of a technique or multiple instantiations of a mechanism unless otherwise noted. For example, a table leg may be described with a sliding mechanism, but can include a plurality of sliding mechanisms while remaining within the scope of the present disclosure unless otherwise noted. Similarly, various techniques and mechanisms may have been described as including a connection between two entities. However, a connection does not necessarily mean a direct, unimpeded connection, as a variety of other entities (e.g., fasteners, spacers, fittings etc.) may reside between the two entities.

For the purposes of this disclosure, reference may be made to directions such as "horizontally" and "vertically." It is appreciated that such terms refer to the ordinary usage with respect to tables. Accordingly, "horizontally" refers to geometry that is substantially (e.g., +/−5 degrees) parallel to the plane of the tabletop while "vertically" refers to planes that are normal to the plane of the tabletop.

It is appreciated that, for the purposes of this disclosure, when an element includes a plurality of similar elements distinguished by a letter or follow-on numeral following the ordinal indicator (e.g., "216A" and "216B", "216-1" and "216-2", or "216A-1" and "216A-2") and reference is made to only the ordinal indicator itself (e.g., "216"), such a reference is applicable to all the similar elements.

INTRODUCTION

Described herein are systems and techniques for lifting tables. As used herein, "tables" may refer to traditional tables such as dining tables, desks, portable tables, work benches, coffee tables, and/or any other structure for supporting items. As described herein, such lifting tables may be configured to be adjustable in height. Height adjustments may allow for the table to be disposed in one of a plurality of different height settings and/or may be continuously adjusted along an adjustment range. Various features of lifting tables may be described.

Lifting Tables

Figure 1:
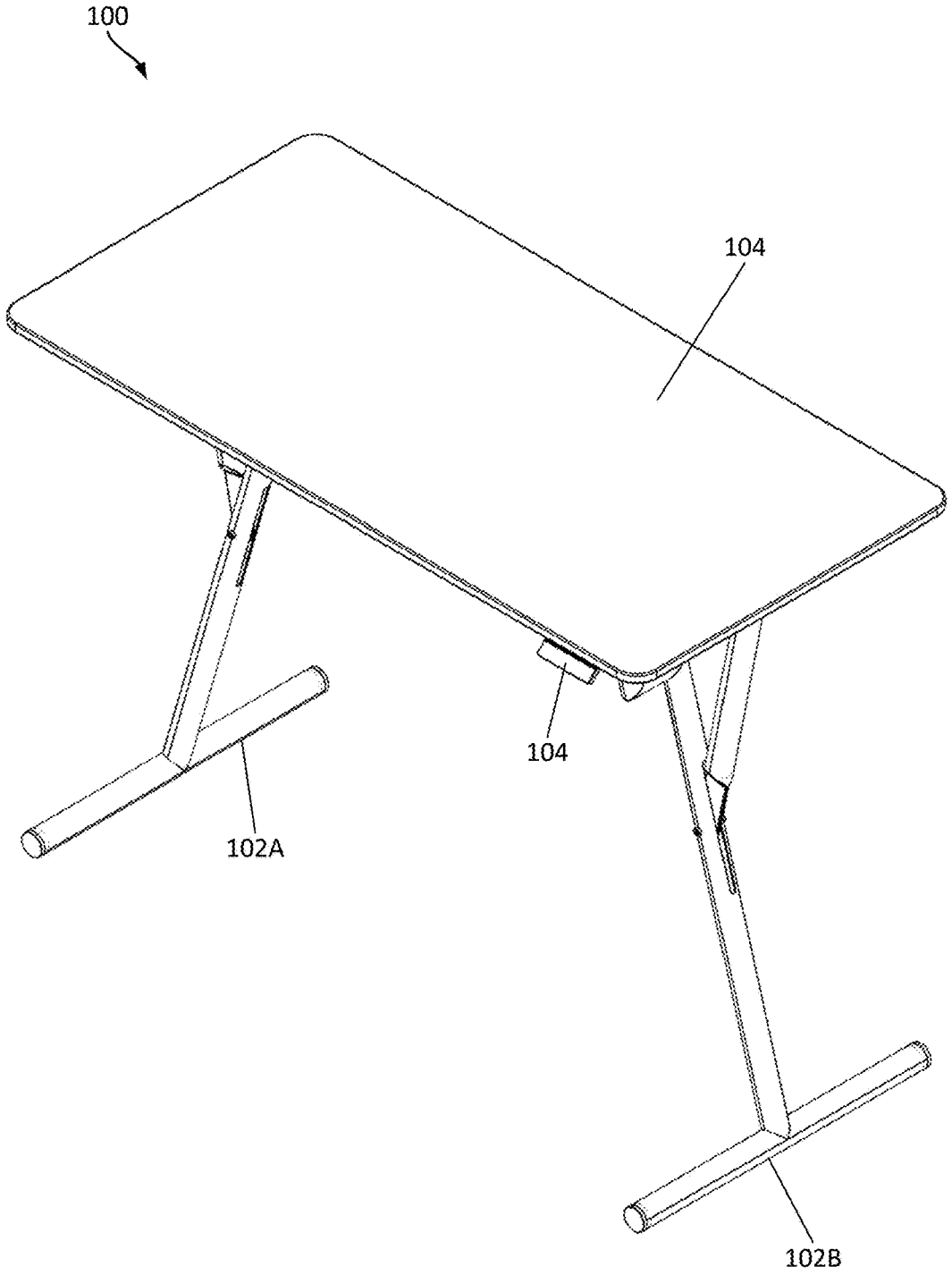
FIGS. 1 and 2 illustrate various perspective views of a lifting table, in accordance with certain embodiments.
Figure 2:
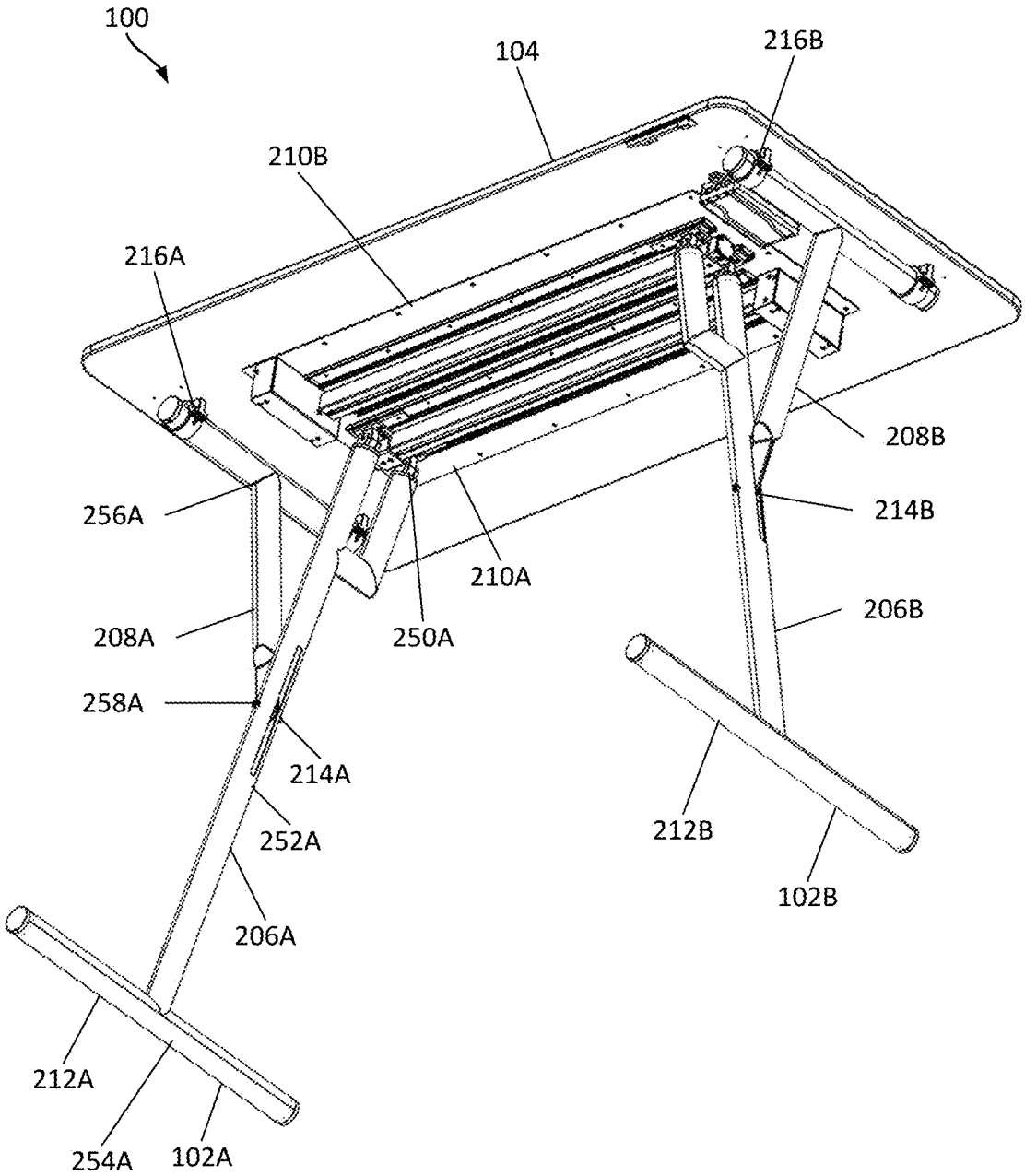

FIGS. 1 and 2 illustrate various perspective views of a lifting table, in accordance with certain embodiments. table 100 may include tabletop 104 and a plurality of leg assemblies, such as table leg assembly 102A and table leg assembly 102B. Each of table leg assembly 102A and table leg assembly 102B may be height adjustable according to the techniques described herein. In certain embodiments, the height of each of table leg assembly 102A and table leg assembly 102B may be infinitely adjustable within an adjustment range.

As shown in FIG. 2, each table leg assembly 102 may include first leg portion 206 and second leg portion 208. First leg portion 206 and second leg portion 208 may move relative to each other via leg hinge 214. First leg portion 206 and second leg portion 208 may be disposed at a non-zero angle relative to each other. In certain embodiments, tabletop 106, first leg portion 206, and second leg portion 208 may be disposed to form a triangle with at least a portion of tabletop 106, first leg portion 206, and second leg portion 208.

Second leg portion 208 may be hinged at first end 256 via hinge 216 and hinged at second end 258 via leg hinge 214. Leg hinge 214 may also be disposed within central portion 252 of first leg portion 206 while first end 250 of second leg portion 208 may be disposed on tracks 210 and configured to slide along (e.g., translate along) tracks 210. The hinges described herein may include any hinges that allow for one portion to move (e.g., rotate) relative to another portion, and may include any number of bearings, flexure joints, bushings, and/or other such elements. The hinges described herein may allow for rotation along one axis of movement or along a plurality of such axes.

Tracks 210 may include one or more tracks that a portion of first leg portion 206 may slide along, as well as a mechanism, such as a screw and block, gears, belt or chain drive, and/or other such mechanisms, configured to control a position of first end 250 of first leg portion 206. Thus, in embodiments wherein tracks 210 are configured to interface with both first leg portion 206A and first leg portion 206B, tracks 210 may include first track assembly 210A configured to interface with first leg portion 206A and second track assembly 210B configured to interface with first leg portion 206B. Tracks 210 may include portions configured for a portion of first leg portion 206 to move along as well as portions for controlling the positioning thereof. Tracks 210 may be disposed along a bottom side of tabletop 104. Tracks 210 may be further described herein.

Second end 254 may include feet 212. In various embodiments, feet 212 may include a round or semi-round profile. As height adjustment of table leg assembly 102 occurs through translation of first end 250, the angle of first leg portion 206 relative to the ground may change depending on the height of table leg assembly 102 (and, thus, the height of tabletop 104 relative to the ground). Second end 254 may thus have a round or semi-round profile so that height adjustment of table leg assembly 102 may be performed smoothly and table leg assembly 102 may be disposed at any height in a stable manner.

Figure 3:
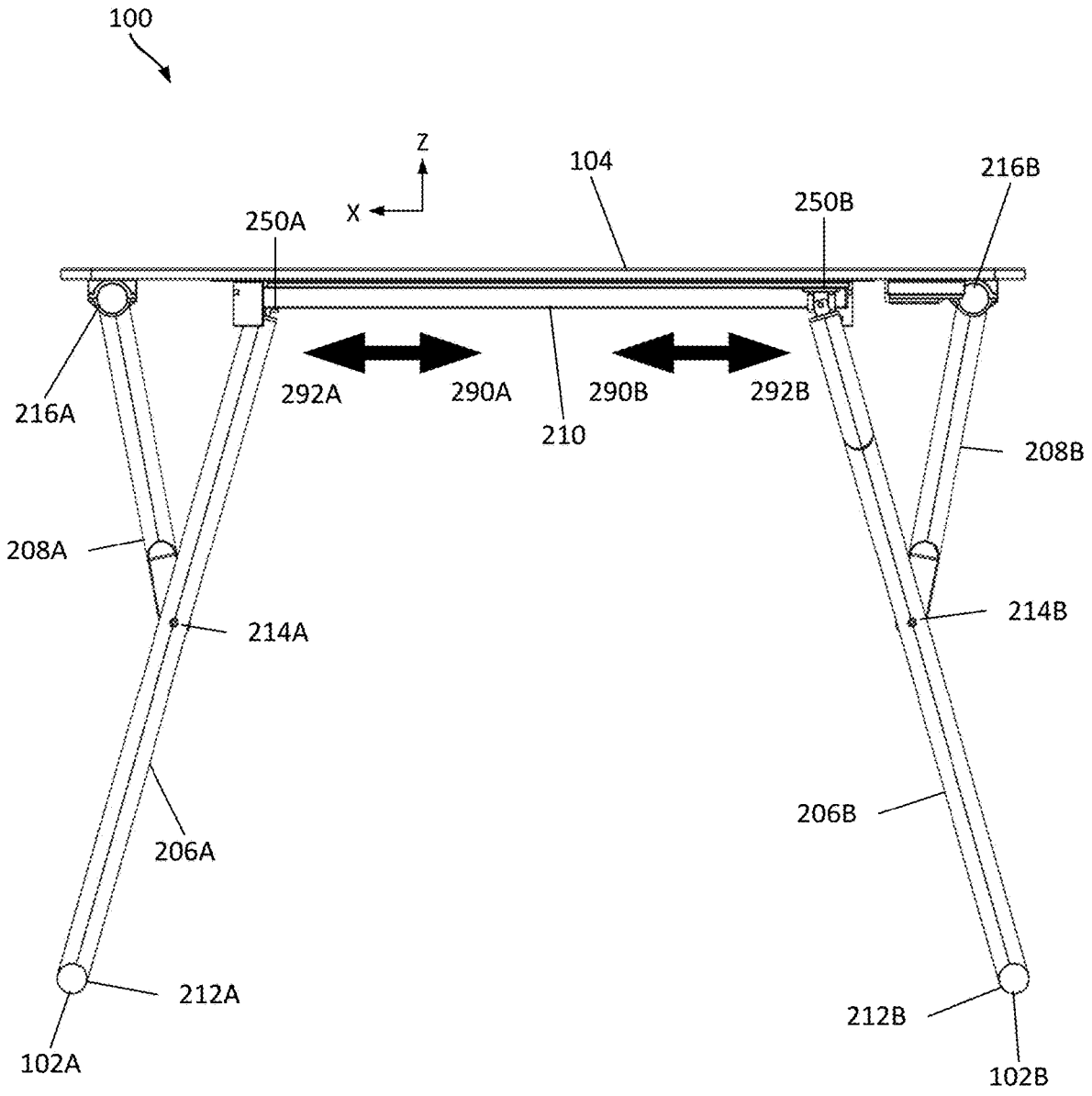
FIG. 3 illustrates a side view of a lifting table, in accordance with certain embodiments.
Figure 4:
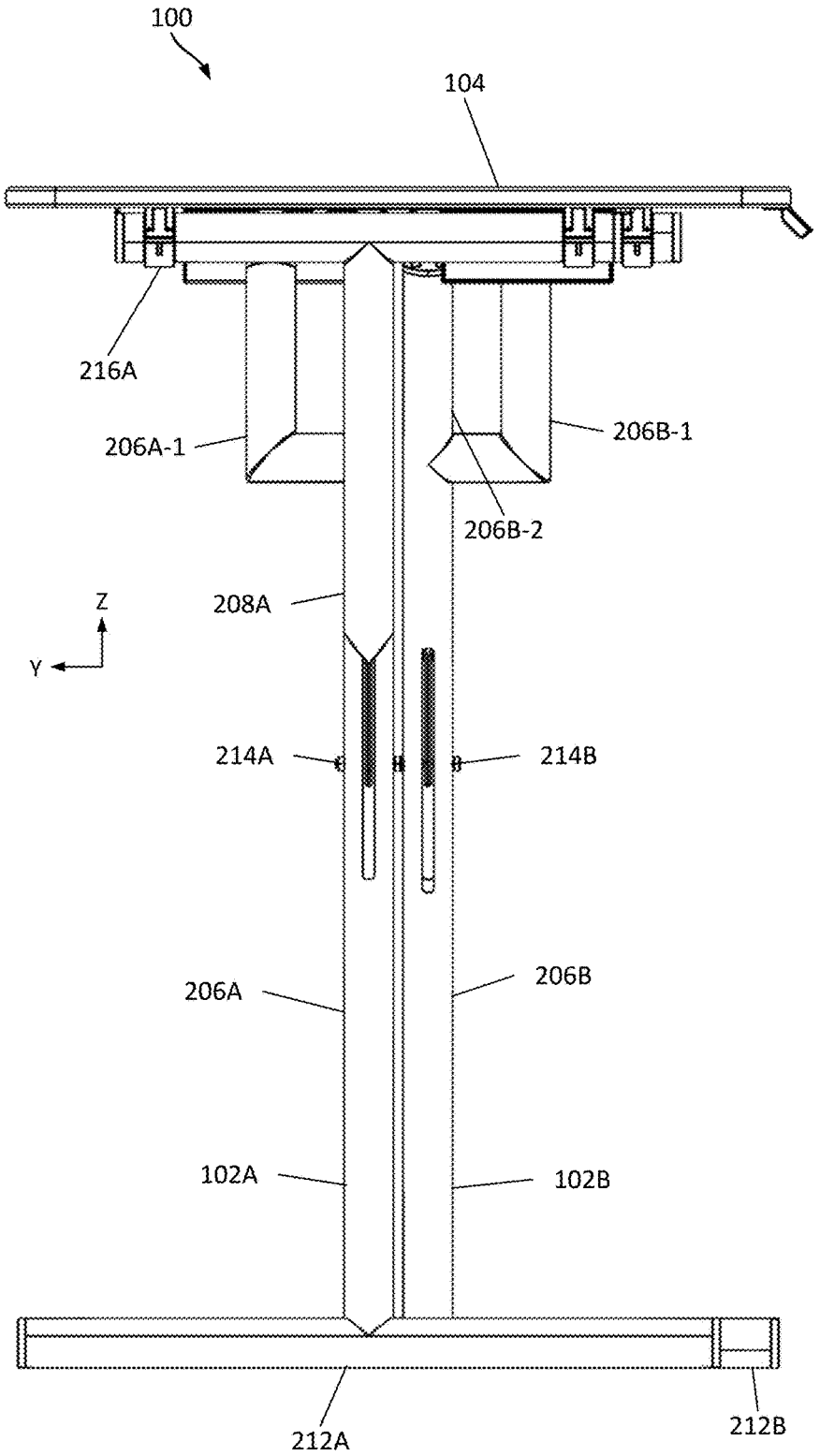
FIG. 4 illustrates a front view of a lifting table, in accordance with certain embodiments.

FIG. 3 illustrates a side view of a lifting table, in accordance with certain embodiments. FIG. 4 illustrates a front view of a lifting table, in accordance with certain embodiments. The side view of FIG. 3 may be normal to the X and Z axes of table 100. Travel and/or dimensions along the X axis may be referred to as the length, lengthwise, or longitudinal. Travel and/or dimensions along the Z axis may be referred to as the height, heightwise, or vertical. The front view of FIG. 4 may be normal to the Y and Z axes of table 100. Travel and/or dimensions along the Y axis may be referred to as the width, widthwise, or lateral.

As shown in FIG. 3, table leg assembly 102A and table leg assembly 102B may be disposed at opposite ends of tabletop 104. For each table leg assembly 102, second leg portion 208 and first leg portion 206 may be oriented to form a triangular structure that increases the strength of each length. Furthermore, as shown in FIG. 3, the structure of table leg assembly 102 may allow for feet 212, at certain heights of tabletop 104, to be disposed past the outer perimeter of tabletop 104 projected onto the ground, leading to a table with greater stability.

In certain embodiments, when table leg assembly 102A and table leg assembly 102B are lowered, first end 250A of table leg assembly 102A and first end 250B of table leg assembly 102B may move in first direction 290A and first direction 290B, respectively. When table leg assembly 102A and table leg assembly 102B are raised, first end 250A of table leg assembly 102A and first end 250B of table leg assembly 102B may move in second direction 292A and second direction 292B, respectively.

As shown in FIG. 4, as tracks 210 for each table leg assembly 102 are disposed alongside each other, each table leg assembly 102 may be offset from each other. Accordingly, when table leg assembly 102A and table leg assembly 102B are lowered and moved along first direction 290A and first direction 290B, respectively, each respective first leg portion 206A and first leg portion 206B may pass each other by at a certain height, which may be seen as first leg portion 206A and first leg portion 206B crossing each other from a side view. Such a configuration allows for table 100 to be set at a lower height than traditional telescoping leg lifting tables.

Furthermore, the configuration of table 100, with offset track 210A and track 210B, allows for leg assembly 102A and/or leg assembly 102B to be fully retracted. That is, in certain embodiments, track 210A and/or track 210B may be of a length that, when first end 250A and/or first end 250B, respectively, are disposed in certain positions (e.g., when second end 258A and/or second end 258B are disposed between 30-70% of the length of first leg portion 206A and/or first leg portion 206B, respectively), leg assembly 102A and/or leg assembly 102B may be positioned so that first leg portion 206 and second leg portion 208 are within 15 degrees of colinear and, thus, leg assembly 102 may be disposed parallel or almost parallel to tabletop 104. Due to such a configuration, table 100 may be flatpacked as an assembled unit and, thus, may be shipped and unpacked ready to use without any assembly required. In certain embodiments, when in the folded configuration, leg assembly 102A and/or leg assembly 102B may be disposed within the perimeter of 102.

It is appreciated that, in certain embodiments, disposing leg hinge 214 lower (e.g., more towards the ground) along the length of first leg portion 206 may allow for a greater range of height adjustment for table leg assembly 102. However, disposing leg hinge 214 lower may increase the torque requirements to raise the height of table leg assembly 102 and may also result in lower load carrying capacity. Thus, in various embodiments, leg hinge 214 may be disposed in the middle half of the length of first leg portion 206 (e.g., from 25% to 75% along the length of first leg portion 206).

In various embodiments, first leg portion 206 may include a forked portion including first leg portion 206-1 and second first leg portion 206-2. Such a configuration may provide for greater stability when table leg assembly 102 is moving and adjusting the height of tabletop 104.

Referring back to FIG. 2, track 210A and track 210B may be disposed alongside each other, allowing for leg assembly 102A and leg assembly 102B to cross each other. Disposing track 210A and track 210B alongside each other allows for a greater length of track. Thus, in certain embodiments, greater than half and up to the entire length of tabletop 104 may be utilized for the length of track 210A and track 210B. Such a configuration allows for a greater amount of height adjustment.

Height Adjustment Mechanism

Figure 5:
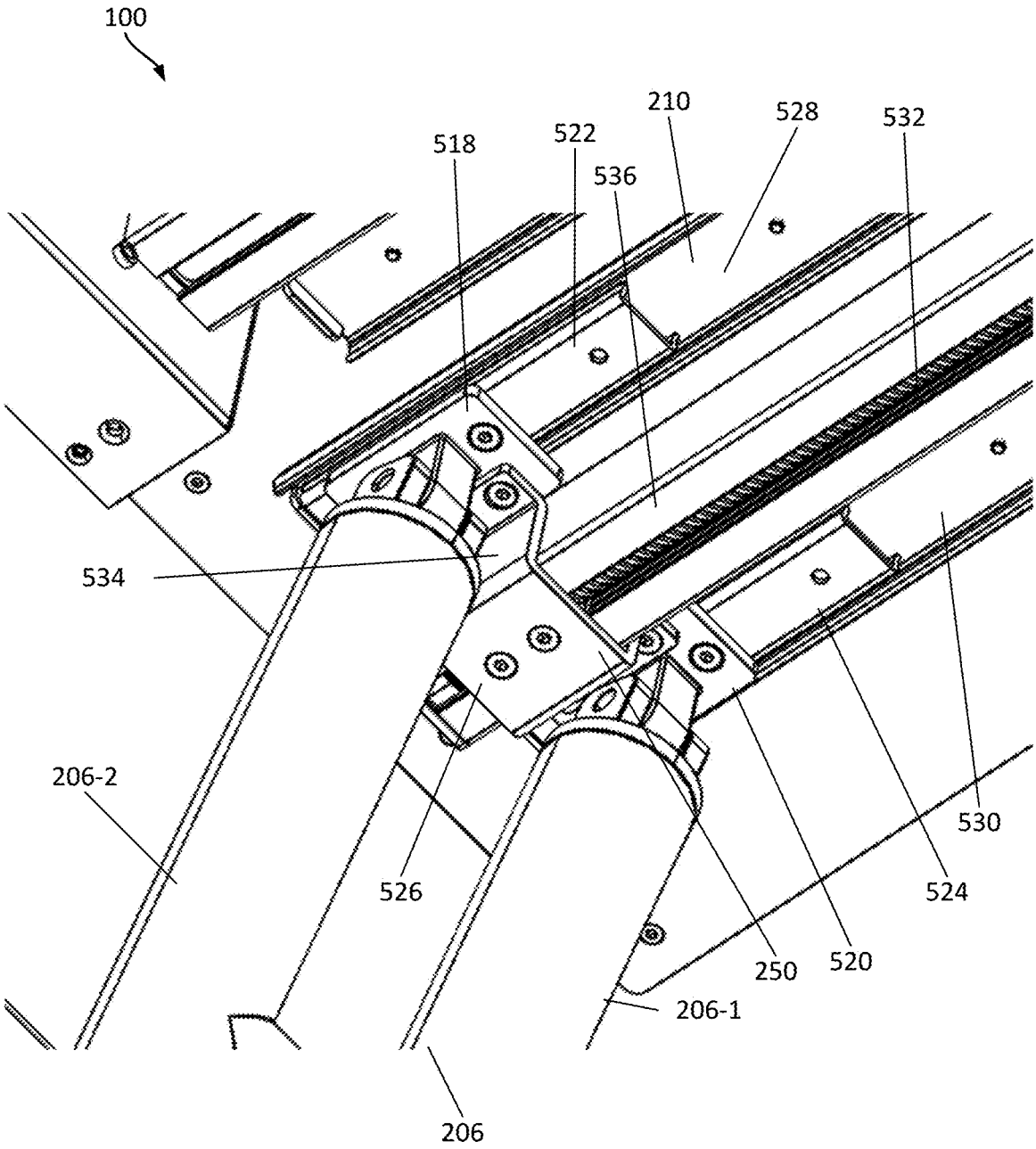
FIGS. 5 and 6 illustrate perspective views of portions of a lifting mechanism of a lifting table, in accordance with certain embodiments.
Figure 6:
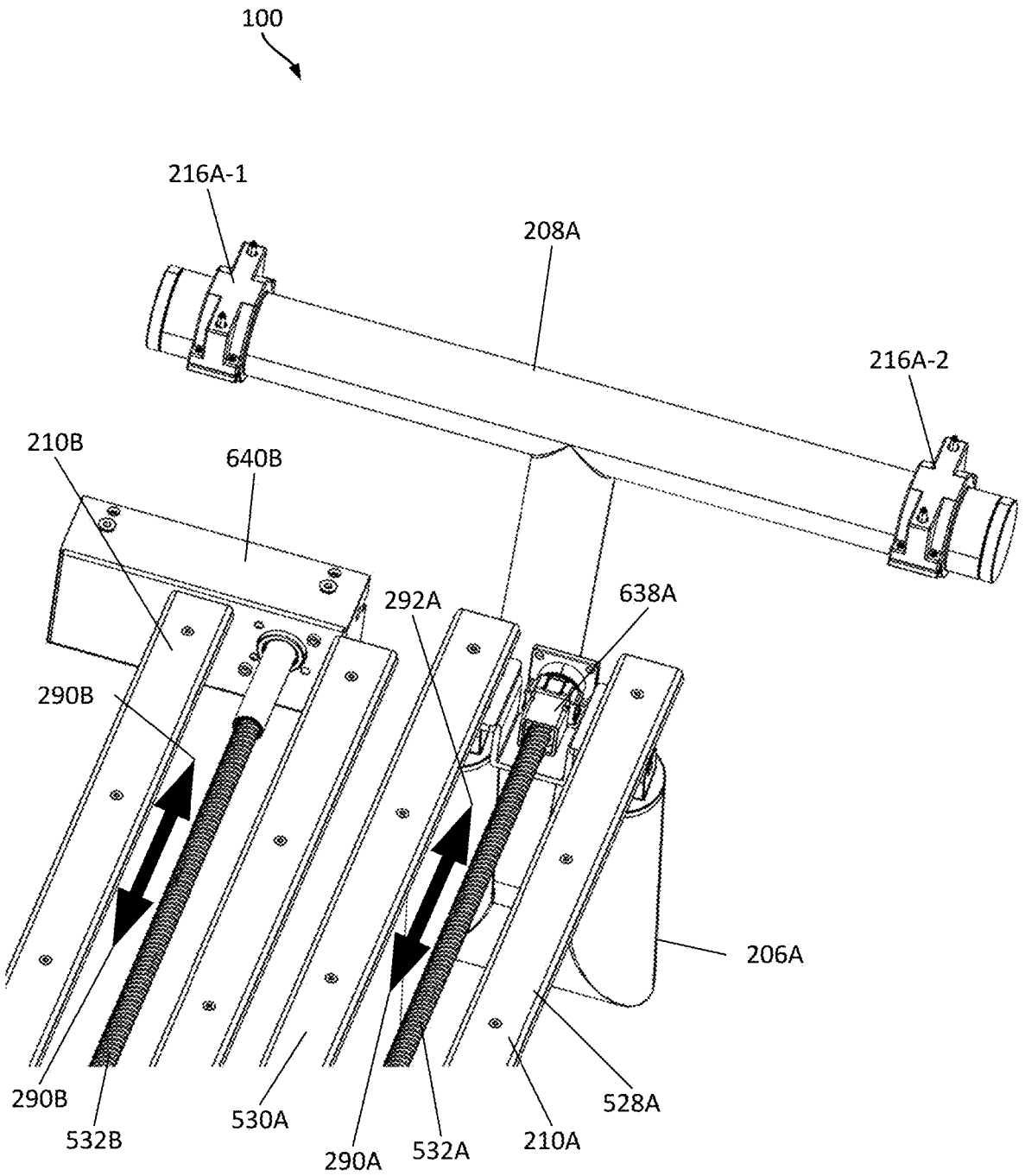

FIGS. 5 and 6 illustrate perspective views of portions of a lifting mechanism of a lifting table, in accordance with certain embodiments. As shown in FIG. 5, first leg portion 206 may include first leg portion 206-1 and second first leg portion 206-2 and adjustment portion 526. In certain embodiments, adjustment portion 526 may be disposed between first leg portion 206-1 and second first leg portion 206-2.

Adjustment portion 526 may be configured to interface with adjustment screw 532 to provide for adjustment of the position of adjustment portion 526 and, thus, first end 250 of first leg portion 206. Such adjustment via adjustment screw 532 and adjustment portion 526 may adjust the height of tabletop 104. In various embodiments, adjustment screw 532 may be a threaded rod or other screw-type adjustor. Adjustment portion 526 may include a corresponding threaded portion receiver 638 configured to receive the threads of adjustment screw 532. Adjustment screw 532 may be turned in a first direction to move adjustment portion 526 and, thus, first end 250 of first leg portion 206 in one of first direction 290 or second direction 292 and turned in a second direction to move adjustment portion 526 and, thus, first end 250 of first leg portion 206 in the other of first direction 290 or second direction 292. In various embodiments, the first direction may raise the height of tabletop 104 and the second direction may lower the height of tabletop 104. The configuration of adjustment screw 532 turning receiver 638 may allow for an analog (e.g., infinitely granular) adjustment range for the height of tabletop 104.

In certain embodiments, adjustment portion 526 may include connector portion 534 that may couple together slider hinge 518 and slider hinge 520, as well as receiver 538, and cause slider hinge 518 and slider hinge 520 to move concurrently. In various embodiments, such coupling may be via any permanent or semi-permanent technique described herein.

Adjustment screw 532 may be turned by motor 640. Motor 640 may be an electric motor or other type of motor and may transmit torque produced by motor 640 to adjustment screw 532 via any technique, such as via gear drive, belt drive, chain drive, piezoelectric devices, and/or another such technique. Operation of motor 640 may be controlled by control panel 160, shown in FIG. 1. Control panel 160 may include one or more buttons, graphical user interfaces, dials, and/or other such components that may allow a user to provide input to control operation of motor 640 and, thus, raise or lower tabletop 104.

In certain embodiments, a single motor 640 may be configured to drive both adjustment screw 532A and adjustment screw 532B. Such configurations may include a linkage, such as gears, pulleys, chain drives, and/or other such that allow for movement of adjustment screw 532A and adjustment screw 532B to be synchronized. Other embodiments may include a first motor 640A configured to turn adjustment screw 532A and a second motor 640B configured to turn adjustment screw 532B. Both motors may receive commands from control panel 160 and may be configured to synchronize operation to provide the same amount of turns to both adjustment screw 532A and adjustment screw 532B.

In certain embodiments, screw track 536 may be disposed around a portion of adjustment screw 532 to prevent fingers or other objects from being jammed into adjustment screw 532. Screw track 536 may include an opening to allow for adjustment portion 526 to couple to receiver 638.

First leg portion 206-1 may include slider hinge 518 with slide portion 522 and second first leg portion 206-2 may include slider hinge 520 with slide portion 524. In certain embodiments, slider hinge 518 and slider hinge 520 may include a hinge to allow first leg portion 206-1 and second first leg portion 206-2 to move (e.g., rotate) relative to tracks 210 and, thus, tabletop 104. Slider hinge 518 and slider hinge 520 may include any type of hinge, including the hinges described herein. Rotation of first leg portion 206-1 and second first leg portion 206-2 relative to tracks 210 may occur when first leg portion 206-1 and second first leg portion 206-2 are translating along track 528 and track 530, respectively (e.g., when height of tabletop 104 is being adjusted).

Slide portion 522 and slide portion 524 may be configured to slide within track 528 and track 530, respectively. Thus, track 528 and/or track 530 may be sliding tracks. In various embodiments, slide portion 522 and slide portion 524 may include any number of wheels, bearings, sliding surfaces, and/or other such items that allow for movement within track 528 and track 530, respectively. In certain embodiments, slide portion 522 and/or slide portion 524 may be captive within track 528 and/or track 530, respectively (e.g., may be disposed within a track, chain, or other item that prevents slide portion 522 and/or slide portion 524 from detaching from track 528 and/or track 530, respectively). Other embodiments may allow for slide portion 522 and/or slide portion 524 to be free-sliding within track 528 and/or track 530, respectively. For free-sliding configurations, there may be no feature of track 528 and/or track 530 that captures slide portion 522 and/or slide portion 524, respectively. In such embodiments, adjustment portion 526 may be coupled to adjustment screw 532 and the weight of tabletop 104 may cause track 528 and/or track 530 to rest on slide portion 522 and/or slide portion 524, respectively.

In various embodiments, slide portion 522 and slider hinge 518 and/or slide portion 524 and slider hinge 520 may be separate components that are coupled together via any permanent (e.g., welding, bonding, and/or other such techniques that do not allow for non-destructive separation) and/or semi-permanent (e.g., via mechanical fasteners, magnets, hook and loops, and/or other such techniques that allow for non-destructive separation) couplings. Other embodiments may include slide portion 522 and slider hinge 518 and/or slide portion 524 and slider hinge 520 as a single monolithic component.

Accordingly, in certain embodiments, adjustment portion 526 may be coupled to connector portion 534 and connector portion 534 may be coupled to one or more slider hinge 518 (e.g., via any permanent and/or semi-permanent technique). In certain other embodiments, one or more of adjustment portion 526, connector portion 534, and/or slider hinge 518 may be combined as a monolithic component. Adjustment portion 526 may include receiver 638 coupled to adjustment screw 522.

Operation (e.g., rotation) of adjustment screw 522 may impart a rotational torque to receiver 638 and, thus, adjustment portion 526. Such rotational torque may be counteracted by slide portion 522 or slide portion 524 of slider hinge 518 disposed on track 210. The flat surface of track 210 may keep slide portion 522 and/or slide portion 524 level and, thus, counteract the rotational torque from operation of adjustment screw 522. By counteracting the rotational torque, rotation of adjustment screw 522 may instead by redirected to result in translation of receiver 638, as well as other portions of first end 250, in first direction 290 or second direction 292.

In the configuration of table 100, adjustment portion 526, which may include receiver 638, may be disposed between slider hinge 518 and slider hinge 520. Thus, adjustment screw 532 may be disposed between track 528 and track 530. Disposing receiver 638 between slider hinge 518 and slider hinge 520 may provide for greater stability as there are bearing surfaces or support on either side of the adjustment mechanism. The forked configuration of first leg portion 206 may, thus, provide for such greater stability.

Figure 7:
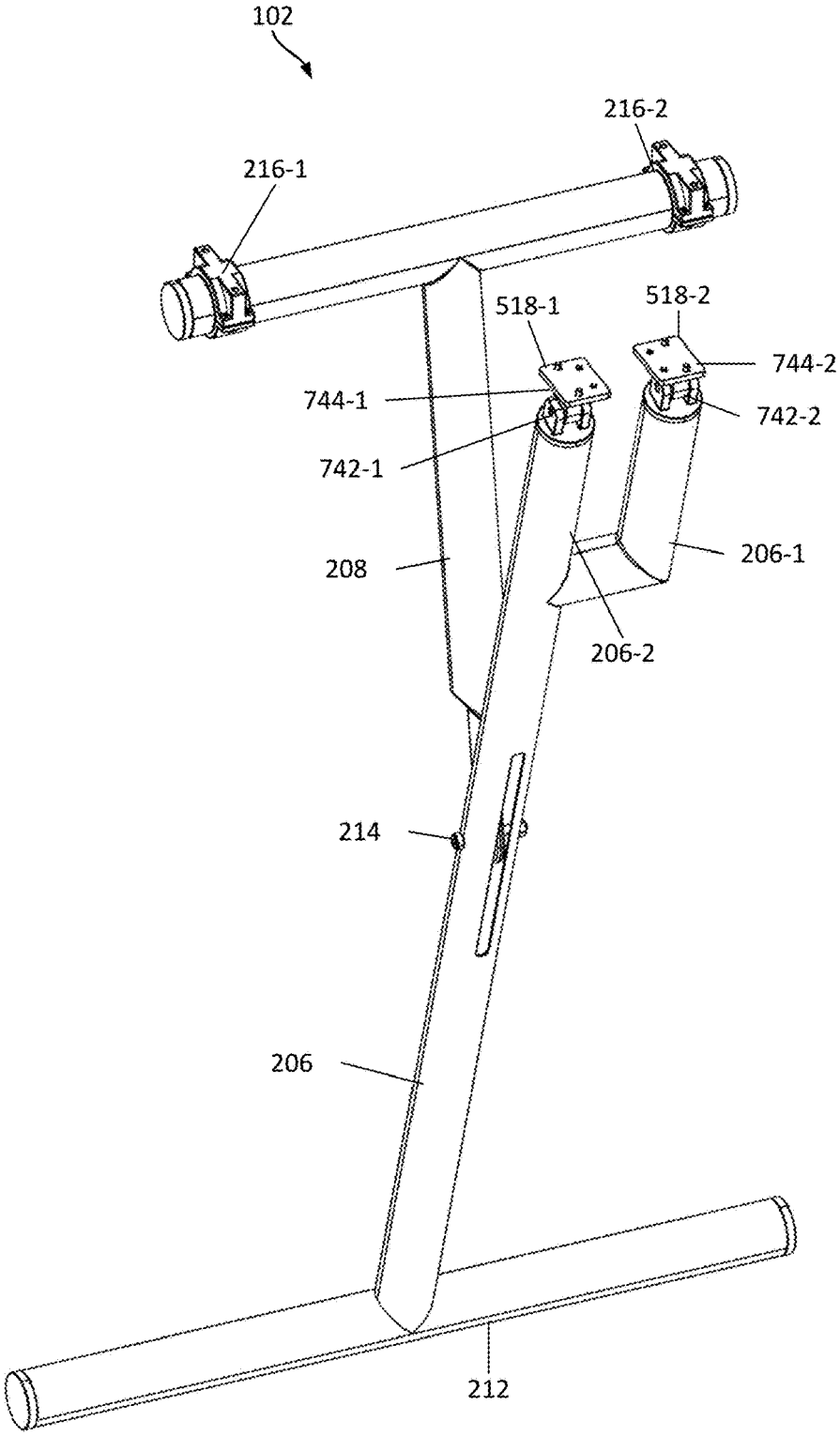
FIG. 7 illustrates a leg assembly of a lifting table, in accordance with certain embodiments.

FIG. 7 illustrates a leg assembly of a lifting table, in accordance with certain embodiments. FIG. 7 may illustrate details of table leg assembly 102, which may include first leg portion 206 and second leg portion 208 that are configured to move (e.g., rotate) relative to each other.

As shown in FIGS. 6 and 7, second leg portion 208 may include first hinge 216-1 and second hinge 216-2 disposed on either end of an upper portion of second leg portion 208.

In certain embodiments, second leg portion 208 may be configured in a T-shape, with a horizontal bar disposed on the upper portion of second leg portion 208. First hinge 216-1 and second hinge 216-2 may be disposed along the end of the upper portion. Such a configuration may also increase the stability of second leg portion 208.

As shown in FIG. 7, first leg portion 206-1 and second first leg portion 206-2 may be disposed upward of leg hinge 214, but other embodiments may dispose first leg portion 206-1 and second first leg portion 206-2 downward of leg hinge 214.

FIG. 7 further illustrates that slider hinge 518 may each include leg hinge 742 and leg slider 744. leg hinge 742 may be a hinge as described herein. Each leg slider 744 may, in certain embodiments, be a sliding surface configured to move along track 528 or track 530. In other embodiments, each leg slider 744 may couple to slide portion 522 or slide portion 524.

CONCLUSION

In the foregoing specification, various techniques and mechanisms may have been described in singular form for clarity. However, it should be noted that some embodiments include multiple iterations of a technique or multiple instantiations of a mechanism unless otherwise noted. Similarly, various techniques and mechanisms may have been described as including a connection between two entities. However, a connection does not necessarily mean a direct, unimpeded connection, as a variety of other entities may reside between the two entities.

In the foregoing specification, reference was made in detail to specific embodiments including one or more of the best modes contemplated by the inventors. While various implementations have been described herein, it should be understood that they have been presented by way of example only, and not limitation. For example, some techniques and mechanisms are described herein in the context of lifting table. However, the techniques of the present invention apply to a wide variety of tables. Particular embodiments may be implemented without some or all of the specific details described herein. In other instances, well known process operations have not been described in detail in order not to unnecessarily obscure the present invention. Accordingly, the breadth and scope of the present application should not be limited by any of the implementations described herein, but should be defined only in accordance with the claims and their equivalents.

The invention claimed is:

1. A lifting table comprising:

a tabletop;

tracks, disposed along a bottom of the tabletop and comprising a first track assembly and a second track assembly, wherein:

the first track assembly comprises:

a first assembly first sliding track; and a first adjustment screw; and the second track assembly comprises:

a second assembly first sliding track; and a second adjustment screw;

a first leg assembly, comprising:

a first assembly first leg portion, comprising a first assembly first leg portion first end, a first assembly first leg portion second end, and a first threaded portion receiver configured to receive the first adjustment screw, wherein the first assembly first leg portion first end is translationally coupled to the first assembly first sliding track via a first sliding surface, and wherein the first assembly first leg portion, at the first assembly first leg portion first end, comprises a first end first portion and a first end second portion;

a first assembly second leg portion, comprising a first assembly second leg portion first end and a first assembly second leg portion second end, wherein the first assembly second leg portion first end comprises a first hinge coupled to the tabletop, and wherein the first assembly first leg portion is disposed at an angle to the first assembly second leg portion and coupled to the first assembly second leg portion via a first leg hinge; and the first leg hinge, wherein the first leg hinge is coupled to the first assembly second leg portion second end and coupled to a central portion of the first assembly first leg portion; and a second leg assembly, comprising;

a second assembly first leg portion, comprising a second assembly first leg portion first end, a second assembly first leg portion second end, and a second threaded portion receiver configured to receive the second adjustment screw, wherein the second assembly first leg portion first end is translationally coupled to the second assembly first sliding track via a second sliding surface;

a second assembly second leg portion, comprising a second assembly second leg portion first end and a second assembly second leg portion second end, wherein the second assembly second leg portion first end comprises a second hinge coupled to the tabletop, and wherein the second assembly first leg portion is disposed at an angle to the second assembly second leg portion and coupled to the second assembly second leg portion via a second leg hinge; and the second leg hinge, wherein the second leg hinge is coupled to the second assembly second leg portion second end and coupled to a central portion of the second assembly first leg portion.

2. The lifting table of claim 1, wherein:

the first track assembly further comprises a first assembly second sliding track;

the first assembly first leg portion first end is translationally coupled to the first assembly second sliding track;

the second track assembly further comprises a second assembly second sliding track; and the second assembly first leg portion first end is translationally coupled to the second assembly second sliding track.

3. The lifting table of claim 1, wherein the first end first portion and the first end second portion form a Y shape.

4. The lifting table of claim 3, wherein the first threaded portion receiver is disposed between the first end first portion and the first end second portion.

5. The lifting table of claim 1, wherein the first end first portion comprises a first slider hinge, and wherein the first end second portion comprises a second slider hinge.

6. The lifting table of claim 1, further comprising:

a first motor configured to turn the first adjustment screw and/or the second adjustment screw.

7. The lifting table of claim 6, further comprising:

a control panel configured to receive inputs and provide outputs to control operation of the first motor.

8. The lifting table of claim 1, wherein the first track assembly and the second track assembly are both disposed lengthwise along the bottom of the tabletop.

9. A lifting table comprising:
a tabletop;
tracks, disposed along a bottom of the tabletop and comprising a first track assembly and a second track assembly, wherein:
the first track assembly comprises:
a first assembly first sliding track; and
a first adjustment screw; and
the second track assembly comprises:
a second assembly first sliding track; and
a second adjustment screw;
a first leg assembly, comprising:
a first assembly first leg portion, comprising a first assembly first leg portion first end and a first assembly first leg portion second end, wherein the first assembly first leg portion first end is translationally coupled to the tracks;
a first assembly second leg portion, comprising a first assembly second leg portion first end and a first assembly second leg portion second end, wherein the first assembly second leg portion first end comprises a first hinge coupled to the tabletop, and wherein the first assembly first leg portion is disposed at an angle to the first assembly second leg portion and coupled to the first assembly second leg portion via a first leg hinge; and
the first leg hinge, wherein the first leg hinge is coupled to the first assembly second leg portion second end and coupled to a central portion of the first assembly first leg portion;
a second leg assembly, comprising;
a second assembly first leg portion, comprising a second assembly first leg portion first end and a second assembly first leg portion second end, wherein the second assembly first leg portion first end is translationally coupled to the tracks;
a second assembly second leg portion, comprising a second assembly second leg portion first end and a second assembly second leg portion second end, wherein the second assembly second leg portion first end comprises a second hinge coupled to the tabletop, and wherein the second assembly first leg portion is disposed at an angle to the second assembly second leg portion and coupled to the second assembly second leg portion via a second leg hinge; and
the second leg hinge, wherein the second leg hinge is coupled to the second assembly second leg portion second end and coupled to a central portion of the second assembly first leg portion;
a first motor, configured to turn the first adjustment screw; and
a second motor, configured to turn the second adjustment screw.

10. The lifting table of claim 9, wherein the first assembly first leg portion further comprises a first threaded portion receiver configured to receive the first adjustment screw, and wherein the second assembly first leg portion further comprises a second threaded portion receiver configured to receive the second adjustment screw.

11. The lifting table of claim 10, wherein the first assembly first leg portion first end is translationally coupled to the first assembly first sliding track, and wherein the second assembly first leg portion first end is translationally coupled to the second assembly first sliding track.

12. The lifting table of claim 11, wherein the first assembly first leg portion first end is translationally coupled to the first assembly first sliding track via a first sliding surface, and wherein the second assembly first leg portion first end is translationally coupled to the second assembly first sliding track via a second sliding surface.

13. A lifting table comprising:
a tabletop;
tracks, disposed along a bottom of the tabletop and comprising a first track assembly and a second track assembly, wherein:
the first track assembly, disposed lengthwise along the bottom of the tabletop and comprising:
a first assembly first sliding track, wherein a first length of the first assembly first sliding track is more than half a length of the tabletop; and
a first adjustment screw; and
the second track assembly, disposed lengthwise along the bottom of the tabletop and comprising:
a second assembly first sliding track; and
a second adjustment screw;
a first leg assembly, comprising:
a first assembly first leg portion, comprising a first assembly first leg portion first end and a first assembly first leg portion second end, wherein the first assembly first leg portion first end is translationally coupled to the tracks;
a first assembly second leg portion, comprising a first assembly second leg portion first end and a first assembly second leg portion second end, wherein the first assembly second leg portion first end comprises a first hinge coupled to the tabletop, and wherein the first assembly first leg portion is disposed at an angle to the first assembly second leg portion and coupled to the first assembly second leg portion via a first leg hinge; and
the first leg hinge, wherein the first leg hinge is coupled to the first assembly second leg portion second end and coupled to a central portion of the first assembly first leg portion;
a second leg assembly, comprising:
a second assembly first leg portion, comprising a second assembly first leg portion first end and a second assembly first leg portion second end, wherein the second assembly first leg portion first end is translationally coupled to the tracks;
a second assembly second leg portion, comprising a second assembly second leg portion first end and a second assembly second leg portion second end, wherein the second assembly second leg portion first end comprises a second hinge coupled to the tabletop, and wherein the second assembly first leg portion is disposed at an angle to the second assembly second leg portion and coupled to the second assembly second leg portion via a second leg hinge; and
the second leg hinge, wherein the second leg hinge is coupled to the second assembly second leg portion second end and coupled to a central portion of the second assembly first leg portion; and
a first motor configured to turn the first adjustment screw and/or the second adjustment screw.

14. The lifting table of claim 13, wherein a second length of the second assembly first sliding track is more than half the length of the tabletop.

15. The lifting table of claim 14, wherein the first assembly first leg portion first end is configured to move in a first direction to lower a height of the tabletop, and wherein the second assembly first leg portion first end is configured to move in a second direction opposite the first direction to lower the height of the tabletop.

16. The lifting table of claim 15, wherein the first assembly first leg portion and the second assembly first leg portion crosses at a first height of the tabletop.

17. The lifting table of claim 15, wherein the first assembly first leg portion first end is configured to move in the second direction to raise a height of the tabletop, and wherein the second assembly first leg portion first end is configured to move in the first direction opposite the second direction to raise the height of the tabletop.

18. The lifting table of claim 13, wherein the first assembly first leg portion further comprises a first threaded portion receiver configured to receive the first adjustment screw, and wherein the second assembly first leg portion further comprises a second threaded portion receiver configured to receive the second adjustment screw.

19. The lifting table of claim 18, wherein the first assembly first leg portion first end is translationally coupled to the first assembly first sliding track, and wherein the second assembly first leg portion first end is translationally coupled to the second assembly first sliding track.

20. The lifting table of claim 19, wherein the first assembly first leg portion first end is translationally coupled to the first assembly first sliding track via a first sliding surface, and wherein the second assembly first leg portion first end is translationally coupled to the second assembly first sliding track via a second sliding surface.

* * * * *